United States Patent [19]

Locatelli

[11] Patent Number: 4,693,067

[45] Date of Patent: Sep. 15, 1987

[54] MIXING HEAD FOR EQUIPMENT FOR JOINING TEXTILE THREADS WITH THE AID OF COMPRESSED AIR

[75] Inventor: Lorenzo Locatelli, Toscolano, Italy

[73] Assignee: Mesdan S.p.A., Salo' , Italy

[21] Appl. No.: 906,267

[22] Filed: Sep. 9, 1986

[30] Foreign Application Priority Data

Sep. 11, 1985 [IT] Italy ..... 22978/85[U]

[51] Int. Cl.[4] ..... B65H 69/06; D01H 15/00

[52] U.S. Cl. ..... 57/22; 57/261; 57/333

[58] Field of Search ..... 57/261, 263, 22, 350, 57/333; 28/271-274

[56] References Cited

U.S. PATENT DOCUMENTS 4,497,165 2/1985 Vollm ..... 57/22

4,610,132 9/1986 Rohnek et al. ..... 57/22

*Primary Examiner*—John Petrakes

*Attorney, Agent, or Firm*—Cushman, Darby & Cushman

[57] ABSTRACT

The present invention provides a mixing head for devices for joining textile threads with the aid of compressed air, for use indifferently for joining short-fibre threads and long-fibre threads, in both the cases perfect joints being obtained, both as regards their tensile strength, and as regards their aesthetical appearance, by being free from thickenings and undesired protrusions at the sides of the same joints.

2 Claims, 2 Drawing Figures

MIXING HEAD FOR EQUIPMENT FOR JOINING TEXTILE THREADS WITH THE AID OF COMPRESSED AIR

The present invention relates to a mixing head for joining textile threads with the aid of compressed air.

It is known that these joining devices are designed to join textile threads, without forming knots, by simple mixing and interlacing of fibres of said textile threads, under the action of compressed air fed into a chamber provided in the mixing head. It is precisely inside this mixing chamber that the free ends of the threads to be joined are introduced and positioned, and that the joining is carried out. The satisfactory outcome of this operation depends on numerous factors, above all also on the textile characteristics of the threads to be joined to each other. It has been possible to observe that the shape and the dimensions of the cross section of the mixing chamber, as well as the way how compressed air is fed thereinto have a considerable influence on the outcome of the joining of the threads, as a function of their textile characteristics.

The most different shapes have been proposed for the mixing chambers with their related inlets for compressed air feed. Generally, chambers having circular, or substantially "V"-shaped, or prismatic, etc., cross section are used, and either single inlets for the introduction of compressed air, or a plurality thereof can be provided.

According to a prior proposal by the same Applicant, a mixing head is constituted by a body wherein a longitudinal chamber having a circular cross section open in correspondence of its ends, and frontally by a longitudinal slot which can be closed by a movable cover provided in the joining device, as well as cylindrical ducts for compressed air feed, freely leading into said chamber are provided. The ratio of the surface area of the transversal cross section of the chamber to the sum of the surface areas of the cross sections of the compressed air feed ducts is comprised, in this solution of the prior art, within the range of from 1.8 to 2.5. At least one duct emerges in the chamber on one side relatively to the longitudinal plane of symmetry of the same chamber, and at least another one of said ducts emerges in the chamber on the opposite side relatively to said plane.

This mixing head of the prior art is particularly suitable for joining short-fibre threads. The air bursts fed into the chamber through said ducts leading into the chamber on opposite sides of the longitudinal symmetry plane at points relatively close to the two chamber ends, viz., with a relatively long distance from each other, in the longitudinal direction, cause the occurrence of rotatory movements of air inside the chamber, with consequent winding around each other of the two threads to be joined together, and creation of a friction between the fibres of the threads, so to achieve an adequate tensile strength of the joint area. The violent rotational motion of one thread around the other allows the short fibres to get ruffled and to get better entangled around the short fibres of the second thread. In this way, besides a better interlacing and mutual copenetration of the short fibres of the threads, also accumulations of fibres on the sides of the joint area are avoided, which would otherways consequently cause thickenings and undesired protrusions of fibres, especially of those of the free ends of the threads, so that the aesthetical appearance of the joint is inproved, and defects in fabric resulting from the joints, and disturbances during the following processing of the threads, especially when they have to be passed through the eyes of knitting needles, and so forth, are minimized.

When to the contrary, by a mixing head of the above disclosed type, performing the joining of long-fibre threads is desired, the mutual rolling up and winding of the threads is not enough to attain a proper tensile strength in the joint area. In fact, in this case, the rotatory movements of air, obtained by feeding air bursts through ducts leading into the chamber on opposite sides of the chamber longitudinal symmetry plane at points longitudinally spaced apart from each other are not able to cause the occurrence of a sufficient interlacing of the long fibres of the threads in the central area of the joint, such to secure the desired tensile strength in this central area.

Purpose of the present invention is hence to provide a mixing head for devices for joining textile threads with the aid of compressed air, for use indifferently for joining short-fibre threads and long-fibre threads, in both the cases perfect joints being obtained, both as regards their tensile strength, and as regards their aesthetical appearance, by being free from thickenings and undesired protrusions at the sides of the same joints.

On order to achieve such a purpose, according to the present invention a mixing head is proposed, of the type of the one proposed according to the prior art, and characterized in that:

(a) two of the ducts for compressed air feed, opposite to each other, leading into the chamber on opposite sides of the longitudinal symmetry plane have their axes lying on transversal planes, the distance of which, in the longitudinal direction of the chamber, from the median transversal plane of the same chamber, can have a value ranging from zero up to a maximum value equal to a half of the diameter of said cylindrical ducts;

(b) provided side-by-side to each of said two ducts opposite to each other, on the side towards the respective end of the chamber, is at least a further parallel duct, the distance between the side-by-side ducts of respective pairs being shorter than a half diameter of the same ducts;

(c) the air feed ducts emerge in the chamber in correspondence of the bottom thereof, and are orientated towards its longitudinal slot with such a slope that the axis of each duct forms with the straight line representing the intersection of the transversal plane on which the same axis lays, with the longitudinal plane of symmetry of the chamber, an angle comprised within the range of from 15° to 32°.

By a so-shaped mixing chamber, on feeding the compressed air, first of all the impact is obtained of the two threads to be joined together against the surface of the cover closing the longitudinal slot of the chamber, thanks to which impact an immediate first mixing and interlacing of the fibres of the threads is obtained. The subsequent rotatory motion, in the direction of the original twisting of the threads, of the free ends of the same threads, due to the preferential direction of the air vortex created on leaving the chamber, allows further more the free ends to be collected around the respective opposite threads.

Thanks to the fact that a considerable interlacing length is obtained in the thread, without the interruption of the interlacing in the central area of the joint, also in this reagion the tensile strength is quite high, so that the mixing head of the present invention is well fitted to be used for joining not only short-fiber-, but also long-fibre threads.

It is understood that also in the mixing head according to the present invention, the arrangement of the ducts for compressed air feed into the chamber on one side and on the other side of the longitudinal symmetry plane of the same chamber with circular cross section must be selected, in a known way, as a function of the thread type, either with Z-twisting (clockwise twisting) or S-twisting (counterclockwise twisting), to be joined, viz., in such a way that the vortices created inside the chamber by the staggered entry of compressed air tend to twist and tighten the fibres in the direction of the thread twisting, and not in the reverse direction, to open them.

In the arrangement and shaping of said ducts according to the invention, the pair of mutually opposite ducts closest to the median transversal plane of the chamber has first of all the function of causing the interlacing and copenetration of the fibres of the two threads to be joined, in the central area of the joint, by compacting the same threads against the surface of the cover which closes the longitudinal slot of the chamber, and thus securing a high tensile strength in said joint area. As also these opposite-to-each-other ducts are the one, with its outlet on one side, and the other, with its outlet on the opposite side of the longitudinal symmetry plane of the chamber, air burst through these ducts, which must anyway leave the chamber through its open ends, is given preferential rotatory motions, which rotatory motions are then furthermore enhanced by the air bursts fed through the supplementary air feed ducts provided side-by-side to said more central ducts. In this way, in the nearby of the joint sides, the winding of the threads, which avoides the presence of undesired fibre protrusions at the ends of the joint area, is favoured.

According to as needed, one, or a plurality of these supplementary ducts can be provided per each one of more central opposite-to-each-other ducts. The mutual distance, in the longitudinal direction of the chamber, between the side-by-side ducts must be the minimum which can be accomplished from the technical viewpoint, and must not substantially exceed a distance equal to a half diameter of the air feed ducts.

Normally, these ducts can all have the same diameter, but it could also be possible to provide the supplementary ducts with a diameter different from the diameter of the more central ducts, on condition that inside the mixing chamber symmetry and equilibrium conditions relatively to the median transversal plane are created.

Also maintaining the slope of the air feed ducts relatively to the straight line representing the intersection of the transversal plane on which the respective axis lays, with the longitudinal symmetry plane of the chamber within the hereinabove indicated limits, viz., between 15° and 32°, has proved to be important. In fact, by taking into account the remaining conditions provided by the invention, with lower slopes the threads would be kept compressed too firmly against the surface of the cover by the air bursts ejected from the ducts, and with higher slopes, the turbulence would be increased too much, and the interlacing of the fibres caused by the bursts would become random and not reliable.

The characteristics of the invention and the advantages resulting from it shall be clearer from the following disclosure of an example of practical embodiment of the mixing head, with reference to the attached drawings, wherein.

Figure 2:
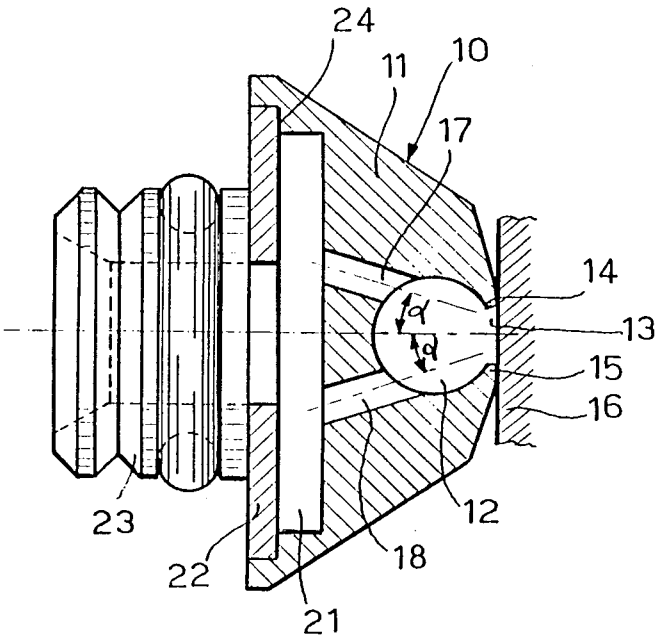
FIG. 2 is a transversal section according to path II—II of FIG. 1.

The mixing head, generally indicated with 10, is constituted by a body 11 normally of aluminum alloy, so shaped as to generally assume a trapezoidal shape. Inside the body 11, a long-shaped mixing chamber 12, having a circular cross section is provided. Frontally, the chamber 12 is open by means of a longitudinal slot 13, and the edges 14, 15 of body 11 which bound this slot (13) are externally flattened, to form a face for a movable cover, schematically indicated in FIG. 2 by the line 16, which, during the joining operation, after the introduction of the ends of the threads to be joined into the chamber 12, closes frontally the same chamber, so that this latter remain only open in correspondence of its opposite ends.

For the feeding of compressed air into the chamber 12 inside the body 11 provided are a plurality of cylindrical ducts all of which, in the illustrated case, have the same diameter.

In particular, a first pair are provided of central opposite-to-each-other ducts, indicated with 17 and 18, the axes of which lay on parallel transversal planes, perpendicular to the longitudinal plane of symmetry of the chamber 12, each of said transversal planes being at a distance from the median transversal plane of the chamber, in the longitudinal axial direction, equal to a half diameter of a duct, thus a distance being obtained between the ducts centres, equal to the diameter of a duct, with the inmost generatrices of the ducts 17 and 18 laying on the same median transversal plane.

However, also providing a more direct opposition to each other of the two ducts (17 and 18) could be possible, but at maximum so that the transversal planes containing the respective two axes of the ducts come to coincide with the said median transversal plane.

A greater mutual opposition of the two ducts 17 and 18 would involve indeed an excessive mutual disturbance of the two air streams ejecting from the ducts, with consequent high turbulence, the occurrence of prevailing vortical movements being hindered, whilst a greater spacing thereof from each other would jeopardize the desired effect of interlacing and copenetration of the fibres of the threads to be joined, caused by the air streams in the central area of the joint.

The ducts 17 and 18 emerge in the chamber 12 in correspondence of the bottom thereof, and they are orientated towards the longitudinal slot 13, with such a slope that the axis of each duct forms an angle $\alpha$ with the straight line representing the intersection between the transversal plane containing the axis and the longitudinal plane of symmetry of the chamber (see FIG. 2). This angle $\alpha$ must have a value comprised within the range of from 15° to 32° C.

Figure 1:
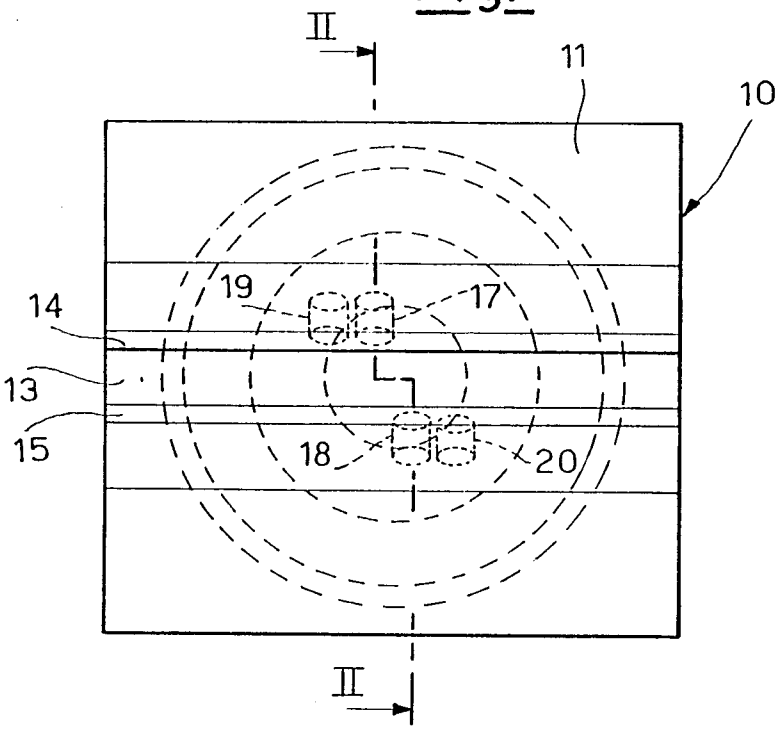
FIG. 1 shows a front view of the mixing head.

It should be observed that the duct 17 leads into the chamber 12 on one side of the longitudinal plane of symmetry, whilst the duct 18 leads into the chamber on the opposite side of said plane: in the case as illustrated, as it results from the front view of FIG. 1, the duct 17 leads into the chamber above, and the duct 18 leads into the chamber beneath the longitudinal plane of symmetry, and this arrangement is suitable for a chamber intended for the joining of threads with S-twisting. In case of threads with Z-twisting, a reverse arrangement should be provided, to obtain that the vortical motions of air be always conform to the twisting of the threads to be joined.

Provided side by side to each of said more central ducts (17 and 18) are the other supplementary ducts 19, 20 which are parallel to the respective ducts 17, 18, viz., have the same slope thereof and, in the illustrated case, have the same diameter as these have. In such a way, it results therefrom the presence of a pair of parallel ducts 17 and 19 emerging into the chamber above the longitudinal plane of symmetry, and a pair of parallel ducts 18 and 20 emerging into the chamber beneath this plane.

The mutual distance between the ducts of each pair must be the minimum distance which can be technically accomplished, and in no way it should exceed the half of the diameter of each duct.

Hence, in the case as illustrated, provided are four ducts 17, 18, 19 and 20 for compressed air feed leding into the mixing chamber 12.

However, providing at the side of each one of the more central ducts 17, 18 more then one supplementary ducts, similar duct 19 and respectively duct 20, could be possible as well, according to the operating requirements.

It must be furthermore stressed that the ratio of the surface area of the cross section of the mixing chamber to the sum of the surface areas of the cross sections of all the cylindrical ducts for the compressed air feed leading into said chamber must remain within the range of fram 1.8 to 2.5. So, for example, in a mixing chamber having a diameter of 3 mm, four air feed ducts each having a diameter of from 1 mm to 1.1 mm can be provided, whilst with a chamber having a diameter of 4 mm, four ducts, each of 1.3–1.4 mm in diameter can be provided.

The ducts for compressed air feed into the mixing chamber are all branching off from a pre-chamber 21 provided in the body 11 behind the chamber 12. The pre-chamber 21 is closed by the flange 22 of a compressed-air fitting 23, which flange is forced into a hollow provided in body 11 and rests against a circular shoulder 24 provided around the pre-chamber 21.

I claim:

1. A mixing head for joining textile threads with the aid of compressed air, comprising:

a body having a cylindrical chamber which is open at each end, said chamber having along its longitudinal length an open slot closable by a removable cover; and a first pair of cylindrical duct means for channeling compressed air into said chamber, the ratio of the cross-sectional area of said cylindrical chamber to the sum of the cross-sectional areas of said cylindrical duct means being in the range of 1.8 to 2.5, said ducts being arranged such that at least one duct is arranged on each side of said cylindrical chamber relative to the cylindrical chamber's longitudinal plane of symmetry; and wherein said cylindrical ducts are further arranged to be spaced in the longitudinal diection on each side of the median transverse plane of said cylindrical chamber a distance not exceeding one half the diameter of said cylindrical ducts; and a second pair of cylindrical ducts parallel to and spaced from said first pair of ducts towards the respective open ends of said cylindrical chamber by a distance not exceeding one half the diameter of said second pair of ducts; and said first and second pairs of ducts being further arranged such that their respective axes of alignment intersect the cylindrical chamber's longitudinal plane of symmetry at an angle in the range of 15° to 32°.

2. A mixing head according to claim 1, wherein said first and second pairs of cylindrical ducts all have the same diameter.

* * * * *